US008105124B2

(12) United States Patent
Williams

(10) Patent No.: US 8,105,124 B2
(45) Date of Patent: Jan. 31, 2012

(54) DEVICES AND METHODS FOR RECOVERING ARTICLES INADVERTENTLY SUBMERGED IN A BODY OF WATER

(76) Inventor: Patrick Brent Williams, Newton Grove, NC (US)

( * ) Notice: Subject to any disclaimer, the term of this patent is extended or adjusted under 35 U.S.C. 154(b) by 50 days.

(21) Appl. No.: 12/707,916

(22) Filed: Feb. 18, 2010

(65) Prior Publication Data

US 2010/0205844 A1 Aug. 19, 2010

Related U.S. Application Data

(60) Provisional application No. 61/153,351, filed on Feb. 18, 2009.

(51) Int. Cl.
*B63B 22/08* (2006.01)

(52) U.S. Cl. ..... 441/7; 441/8

(58) Field of Classification Search ..... 441/7, 8
See application file for complete search history.

(56) References Cited

U.S. PATENT DOCUMENTS 4,126,907 A * 11/1978 Fish ..... 441/8
4,260,075 A 4/1981 Mackal
4,953,316 A 9/1990 Litton, Sr. et al.
5,156,562 A * 10/1992 Pearson et al. ..... 441/8
5,842,301 A * 12/1998 Cassem ..... 43/25
6,036,559 A * 3/2000 Arnold et al. ..... 441/8

* cited by examiner

*Primary Examiner* — Stephen Avila

(74) *Attorney, Agent, or Firm* — Hunton & Williams LLP

(57) ABSTRACT

A device and method for recovering articles inadvertently submerged in a body of water are disclosed. The device comprises a housing attachable to the article, the housing defining a storage chamber with a storage chamber opening at one end. The storage chamber contains a buoyant flotation element held in the storage chamber by a water-activated release mechanism that permits the flotation element to move toward and through the storage chamber opening when the device is submerged in water. The flotation element remains connected to the housing by a connection mechanism. The device housing also may include a biasing mechanism configured to bias the flotation element toward the storage chamber opening. The method includes attaching the housing to the article to be retrieved, having the flotation element release from the housing and float to the surface of the water and following the connection mechanism from the flotation element to the housing.

20 Claims, 5 Drawing Sheets

DEVICES AND METHODS FOR RECOVERING ARTICLES INADVERTENTLY SUBMERGED IN A BODY OF WATER

CROSS-REFERENCE TO RELATED APPLICATIONS

This application claims priority to U.S. Provisional Application No. 61/153,351, entitled "Underwater Recovery Device," filed on Feb. 18, 2009, which is hereby incorporated by reference in its entirety.

FIELD OF THE DISCLOSURE

The present invention relates generally to an article recovery device and method, and more specifically to a device and method for recovering an article inadvertently submerged in water.

BACKGROUND INFORMATION

Articles used near a body of water sometimes are dropped inadvertently into the body of water. If the article weighs more than the water that it displaces, it sinks. Articles intended to be used in a body of water also sometimes are submerged inadvertently.

Once an article is submerged, the article may be difficult to locate because of the depth and opacity of the body of water and because of the tendency of currents in a body of water to move the article from the location where it was submerged initially. In addition to characteristics of a body of water that may make the inadvertently submerged article difficult to locate, the body of water may have characteristics that make searching for the article difficult or even dangerous. For example, the depth of the body of water may prevent the searcher from spending a sufficient period of time on the floor of the body of water to locate the article; the temperature of the body of water may prevent the searcher from entering the body of water at all or, at least, decrease the amount of time that the searcher can remain in the body of water conducting a search; rapid currents and objects, including animals, may make entering the body of water to conduct a search dangerous.

Current devices and methods for addressing the issue of inadvertently submerged articles focus on preventing the article from ever being submerged or from being submerged very far. For example, a small article, such as a boat key, may be attached to a small flotation device that prevents the key from sinking any further than permitted by the attachment mechanism. A larger article, such as a digital camera, may be placed in a protective casing that enables the article to be used near water and permits the encased article to float. Other large articles may be kept in a protective case that floats but prevents usage of the article while it is stored in the case. Finally, the article itself, regardless of size, may be designed to float during use, i.e., watercraft or vessels or parts thereof.

A problem presented to the designer is the recovery of those articles that are inadvertently submerged because their size or mass precludes attachment of a reasonably sized flotation device or encasement. Another problem presented to the designer is providing a way to recover those articles that does not interfere with articles' normal use.

SUMMARY OF THE INVENTION

Accordingly, various embodiments of the invention are directed to a device and method for recovering an article that inadvertently has become submerged in a body of water that does not interfere with the article's normal use. The recovery device comprises a housing with an attachment mechanism that enables the housing to be attached to the article to be recovered. The housing defines a storage chamber with an opening at at least one end of the storage chamber. The storage chamber contains a flotation element that is buoyant in water. When the device is not submerged in water, the flotation element is prevented from moving toward the opening in the storage chamber by a release mechanism. Submersion in water activates the release mechanism, permitting the flotation element to move toward and through opening in the storage chamber. In some embodiments, the storage chamber also contains a biasing mechanism that biases the flotation element toward the opening in the storage chamber. The flotation element is connected to the housing in a manner that permits the connection to remain intact even as the flotation element floats away from the housing.

Once the article to be recovered inadvertently is submerged, the release mechanism is activated. Upon activation, the release mechanism no longer secures the flotation element inside the housing. Free of the housing, the flotation element floats to the surface of the water. The flotation element can be seen on the surface of the water. Once the flotation element is seen, the connection between the flotation device and the housing can be followed from the flotation element to the housing, which is attached to the article to be recovered. The article then can be recovered.

In one embodiment, the recovery device is attached to the threaded forward end of a shotgun magazine. Because each shotgun manufacturer uses a distinct thread pattern for the threaded opening, a base member may be used to facilitate attachment of the recovery device to the shotgun. The base member may be available in multiple versions, all versions having an internal threaded section configured to engage the threaded forward end of a shotgun magazine on one end and an attachment mechanism to attach the recovery device on a second end. The base member versions are distinguished by each version having an internal threaded section configured to engage the threaded forward end of a specific shotgun manufacturer. The use of the appropriate base member permits a single recovery device attachment mechanism to work with shotguns made by multiple manufacturers. The use of a base member also permits the attachment to the shotgun of other accessories, including, but not limited to, a flashlight and a dry storage tube, that use the same attachment mechanism used on the recovery device.

BRIEF DESCRIPTION OF THE DRAWINGS

In order to facilitate a fuller understanding of an exemplary embodiment, drawings are appended. These drawings should not be construed as limiting, but are intended to be exemplary only.

DETAILED DESCRIPTION OF THE INVENTION

Use of articles in or near a body of water inevitably results in some articles inadvertently being submerged in the body of water. This fact is true of articles used near a body of water, including, but not limited to, firearms and fishing equipment, as well as articles used in a body of water, including, but not limited to, watercraft and vessels. Some of these articles may remain useful if recovered or may present a danger to individuals or the environment if not recovered. Recovery of such an article, however, may be difficult, particularly in situations where the article may be difficult to locate or where searching for the article may be difficult or dangerous. The present invention contemplates devices and methods to recover such articles without interfering with the normal use of the articles. The recovery device contemplated is attached to the article to be recovered.

Reference now is made in detail to an exemplary embodiment, an example of which is illustrated in the accompanying drawings. It should be appreciated that the same reference numbers are used throughout the drawings to refer to the same or like parts. It should be appreciated that the following detailed description is exemplary and explanatory only and is not restrictive.

Figure 1:
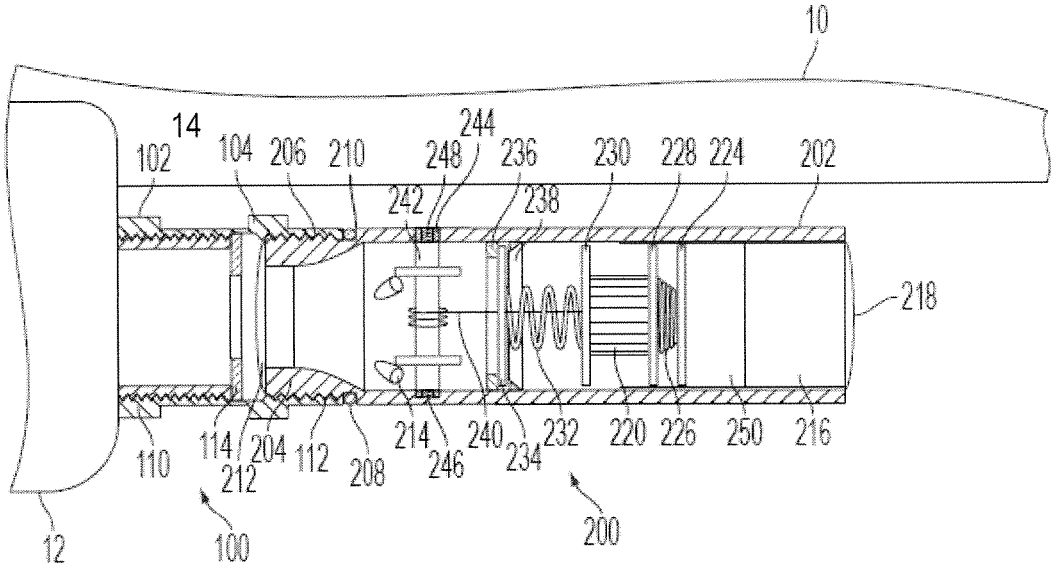
FIG. 1 depicts a cutaway view of a recovery device mounted to an article using a base member, according to an exemplary embodiment.
Figure 2:
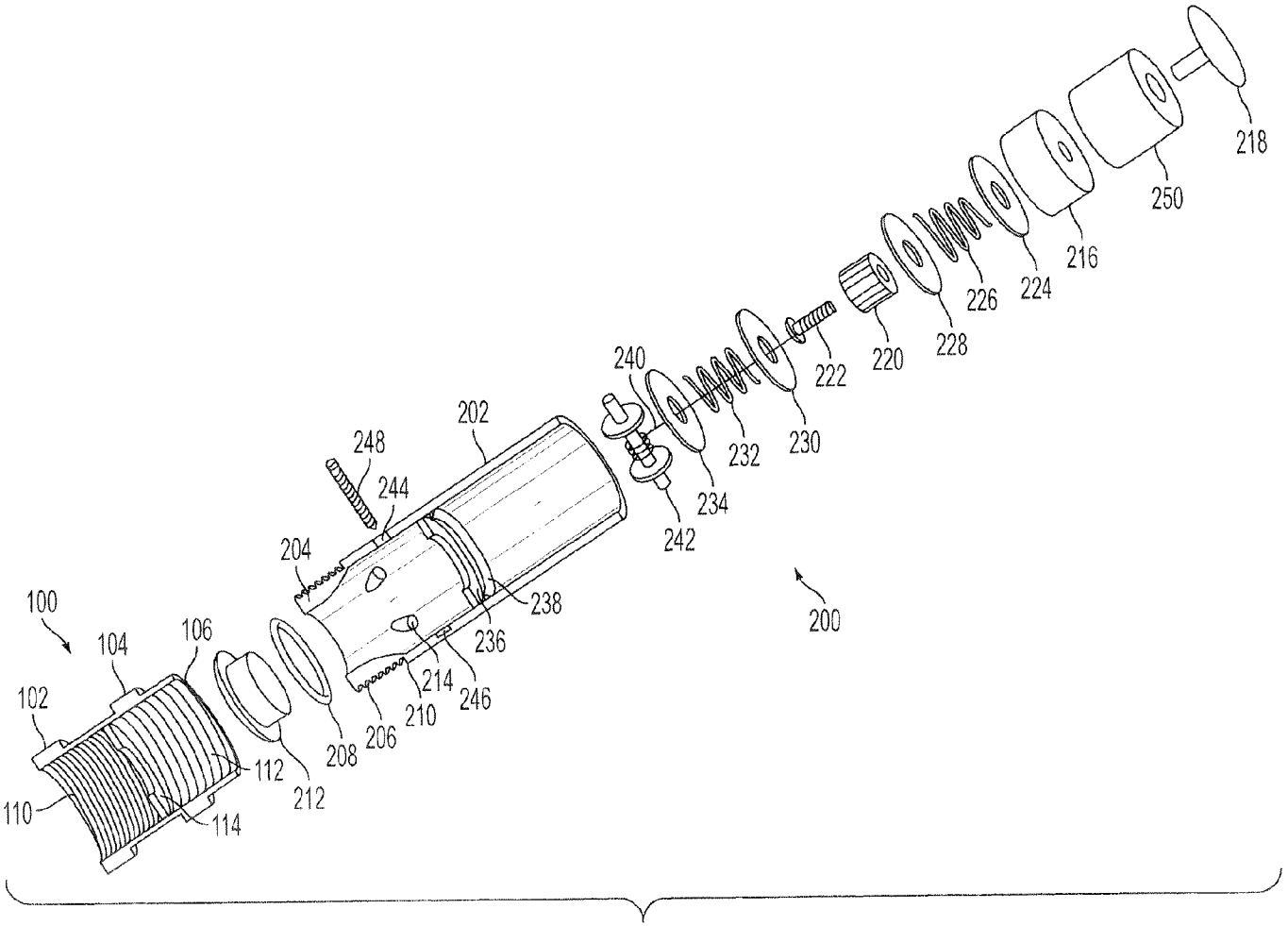
FIG. 2 depicts an exploded view of a recovery device with a base member, according to an exemplary embodiment.

Referring now to FIGS. 1 and 2, a base member 100 and a recovery device 200 are shown according to an exemplary embodiment. In the exemplary embodiment, the recovery device 200 is intended to aid in the recovery of a shotgun when the shotgun is dropped in the water while hunting in, around, over or near water. Those of ordinary skill in the art will recognize that the concepts described are scaleable to larger and smaller articles and that only the attachment scheme for, and possibly the size of, the device may need to be modified to accommodate such articles. By way of convention, the end of a component closer to the butt of the shotgun is referred to as the aft end of the component; the end of a component closer to the muzzle of the shotgun is referred to as the forward end of the component.

In the exemplary embodiment, the recovery device 200 is intended to be attached to the shotgun at the threaded forward end 14 of the magazine 12 and below the barrel 10. Because each shotgun manufacturer uses a distinct thread pattern for the threaded opening 14, the base member 100 may be used to facilitate attachment of the recovery device 200 to the shotgun.

Referring now to FIG. 1, the forward portion of a shotgun is depicted with a base member 100 attached to the shotgun and a recovery device 200 attached to the base member 100. Specifically, FIG. 1 depicts a barrel 10 attached to a magazine 12. The magazine 12 includes a threaded forward end 14. The threaded forward end 14 of the magazine 12 permits the barrel 10 to be secured to the magazine 12. In a standard shotgun configuration, the shotgun barrel 10 is secured to the magazine 12 by securing a threaded cap (not shown) onto the threaded forward end 14. In the exemplary embodiment, the threaded cap may be replaced by a hollow cylindrical base member 100 open at both ends.

Figure 3:
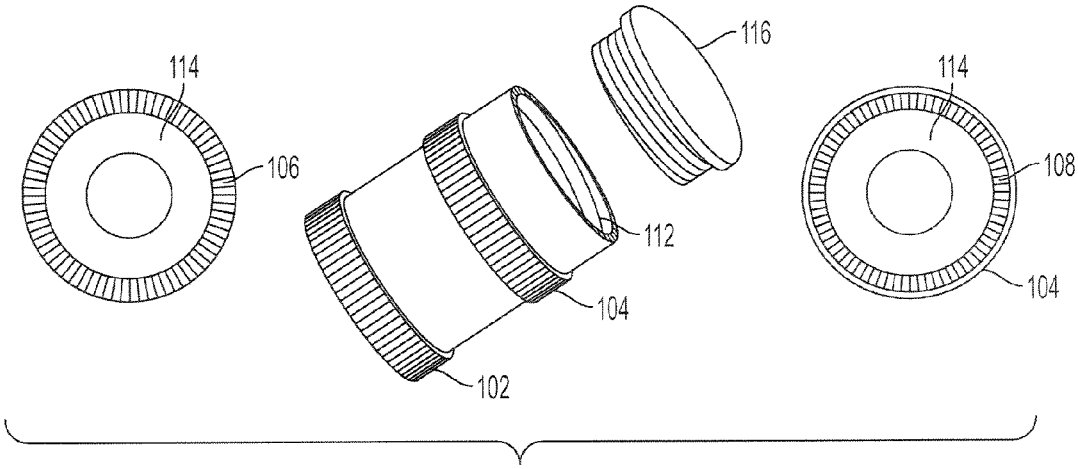
FIG. 3 depicts an aft, side and forward view of a base member, according to an exemplary embodiment.

FIG. 3 depicts the base member 100 from the aft end, the side and the forward end. The outer diameter of the base member 100 may include a raised band 102 adjacent to the aft end of the base member 100 that extends around the circumference of the base member 100. The raised band 102 may incorporate axial ridges that are parallel to the longitudinal axis of the base member 100. The outer diameter of the base member 100 may include a second raised band 104 that extends around the circumference of the base member 100 separate from, and forward of, the raised band 102. The second raised band 104 may incorporate axial ridges that are parallel to the longitudinal axis of the base member 100. The raised band 102 and the second raised band 104 are not integral to the function of the base member 100 but are included to offer a better grip on the base member 100 when supplying the torque necessary to attach the base member 100 to the forward end of the magazine 12. The aft end of the base member 100 may incorporate ridges 106 that extend radially outward from the inner diameter of the base member 100 to the outer diameter of the raised band 102. The forward end of the base member 100 may incorporate ridges 108 that extend radially outward from the inner diameter to the outer diameter of the base member 100. If the second raised band 104 is adjacent to the forward end 108 of the base member 100, the ridges 108 at the forward end of the base member 100 may extend radially outward from the inner diameter of the base member 100 to the outer diameter of the raised band 104. The ridges 106 on the aft end of the base member 100 and the ridges 108 on the forward end of the base member 100 are not integral to the function of the base member 100 but are included to offer resistance to the base member 100 becoming unattached once the aft end of the base member 100 is attached to the threaded forward end 14 of the magazine 12 or an accessory, including, but not limited to, the recovery device 200, is attached to the forward end of the base member 100.

As illustrated in FIG. 1 and FIG. 2, the inner diameter of the base member 100 closer to the aft end is threaded. The threads 110 closer to the aft end of the base member 100 are configured to engage the threads on the threaded opening 14 at the forward end of the magazine 12. Because each shotgun manufacturer employs a distinct thread pattern for the threaded opening 14, the base member 100 may be available in multiple versions, each version having threads 110 configured to engage the distinct thread pattern employed by a single shotgun manufacturer. The base member 100 enables the recovery device 200, or other accessory, to attach to any shotgun, regardless of manufacturer, with a single attachment mechanism.

The inner diameter of the base member 100 closer to the forward end may be threaded to engage a thread pattern selected for the recovery device 200 and other accessories. Because the threads 112 closer to the forward end of the base member 100 are intended to engage a threaded portion of the recovery device 200 or other accessory, the threads 112 of the base member 100 may remain the same even as the threads 110 of the base member 100 are changed to engage the distinct thread pattern employed by a single shotgun manufacturer. Because the threads 112 of the base member 100 are a releasable attachment mechanism, other releasable attachment mechanisms, including, but not limited to, quick disconnect, snapping and magnetic mechanisms may be employed without altering the concept of the invention.

The base member 100 may incorporate an internal shoulder 114 between the threads 110 of the base member 100 and the threads 112 of the base member 100. The internal shoulder 114 may include a centrally located circular hole. The internal shoulder 110 may be located along the longitudinal axis of the base member 100 so as to add additional support or serve as a backup to the manufacturer's magazine that holds shotgun shells in the magazine 12 in the same manner as the cylindrical cap that the base member 100 replaces.

As illustrated in FIG. 3, the base member 100 may include a forward end cap 116. The external diameter of the body of the forward end cap 116 may be threaded to engage the threads 112. The forward end cap 116 may be used to close off access to the magazine 12 when neither the recovery device 200 nor another accessory is in use. When used independent of the recovery device 200 or other accessories, the base member 100 functions as the threaded cap used to secure the barrel 10 to the magazine 12 in the standard shotgun configuration.

FIG. 1 depicts the recovery device 200 attached to the base member 100 in the exemplary embodiment. FIG. 2 depicts an exploded view of the recovery device 200 in the exemplary embodiment. The recovery device 200 includes a housing 202, the housing 202 being attachable to the article to be recovered. In the exemplary embodiment, the housing 202 consists of a hollow cylinder with both ends open. The housing 202, may be made of any suitable material, including, but not limited to plastic, wood or metals, including, but not limited to, aluminum or titanium. The housing 202 includes an attachment section 204 at the aft end of the housing 202. The attachment section 204 has a smaller internal diameter than the remainder of the housing 202. The external diameter of the attachment section 204 is threaded to engage the threads 112 of the base member 100. Because the threads 206 on the external diameter of the attachment section 204 are a releasable attachment mechanism, other releasable attachment mechanisms, including, but not limited to, quick disconnect, snapping and magnetic mechanisms may be employed without altering the concept of the invention. A flexible o-ring 208 with an internal diameter sized to fit tight over the external diameter of the attachment section 204 and an external diameter slightly smaller than the external diameter of the remainder of the housing 202 is located at the forward end of the attachment section 202 with the forward end of the o-ring 206 resting against the shoulder 210 at the interface of the attachment section 204 and the remainder of the housing 202. It should be appreciated that other types of housings or attachment mechanisms may be used in other embodiments.

In the exemplary embodiment, the recovery device 200 includes an end cap 212 sized to cover the aft end of the attachment section 204 without interfering with the engagement between the threads on the external diameter of the attachment section 204 and the threads 112 of the base member 100. The end cap 212 may include a snapping feature (not shown) that holds the end cap 210 in place once it is inserted into the aft end of the attachment section 204.

In the exemplary embodiment, the housing 202 includes, forward of the attachment section 204, a plurality of holes 214 that permit water to enter the housing 202 when the recovery device 200 is submerged in water and to drain from the housing 202 when the recovery device 200 is removed from the water. The plurality of holes 214 are equally spaced around the circumference of the housing 202. The plurality of holes 214 pass through the wall of the housing 202 at a non-ninety degree angle to the longitudinal axis of the housing 202.

The recovery device includes a flotation element 216 configured to float in water. The flotation element may be made of any suitable material that is less dense than water, including, but not limited to, foam, cork, wood or plastic. The flotation element also can be made of any suitable material that is more dense than water as long as the flotation element is configured to weigh less than the water that it displaces. The flotation element 216 is secured in the housing 202 by a water-activated release mechanism 220. The location of the release mechanism 220 relative to the flotation element 216 in the housing 202 does not matter as long as the release mechanism 220 secures the flotation device 216 in the housing 202 until the housing 202 is submerged in water.

In the exemplary embodiment, the flotation element 216 is a solid cylinder made of a buoyant foam material with a relatively small diameter hole running through the center along the longitudinal axis. The flotation element 216 is secured in the housing 202 by a rivet-shaped flotation cap 218 at the forward end of the flotation element 216, secured to the water-activated release mechanism 220 by the securing mechanism 222, the release mechanism 220 secured to other components that are secured to the housing 202. When the release mechanism 220 is submerged in water, the release mechanism 220 releases the securing mechanism 222, releasing the flotation element 216, with the flotation cap 218 and securing mechanism 222 still attached, from the housing 202.

The body of the rivet-shaped flotation cap 218 extends from the forward end through to the aft end of the flotation element 216. The aft end of the body of the flotation cap 218 is coplanar with the aft end of the flotation element 216. The hollow body of the flotation cap 218 is internally threaded.

The aft end of the flotation element 216 is attached to the forward end of an annular-shaped spring forward support 224. Where the flotation element 216 is made of a harder material, the spring forward support 224 may not be included. The aft end of the spring forward support 224 rests against, but is not connected to, the forward end of a conical compression coil spring 226. The spring 226 is tapered to be larger in diameter at the aft end than at the forward end. Other types of springs or biasing mechanisms may be used in place of the spring 226. When the flotation element 216 is secured in the housing 202, the spring 226 is fully compressed, as illustrated in FIG. 1. The aft end of the spring 226 is attached to the forward end of an annular-shaped spring aft support 228.

The aft end of the spring aft support 228 is attached to the forward end of the release mechanism 220. The release mechanism 220 used in the exemplary embodiment is a device used in automatic inflatable personal flotation devices, the operation of which is generally similar to the latching means disclosed in U.S. Pat. No. 4,260,075, and one example of which is the product marketed by Mustang Survival as a Halkey Roberts Replacement Bobbin. The release mechanism 220 consists of a hollow supporting cylinder the forward end of which has a plurality of fingers around the inner circumference of the cylinder and extending therefrom toward the radial center of the cylinder. Before coming into contact with each other, each finger turns ninety degrees and extends along the longitudinal axis to the aft end of the cylinder. Near the aft end of the cylinder, each finger has a ridge that extends toward the radial center of the cylinder. The ridges form a support ring. The portion of each finger that extends along the longitudinal axis is prevented from moving toward the inner diameter of the supporting cylinder by a ring of water soluble material placed between the inner diameter of the cylinder and the outer diameter of the ring of fingers. Once the water soluble material is dissolved by contact with water, the fingers easily are pushed radially outward toward the inner diameter of the supporting cylinder.

In the exemplary embodiment, the securing mechanism 222 is a screw, the diameter of the head of which is sized to fit into the cylinder formed by the fingers of the release mechanism 220 but not through the support ring formed by the ridges on the fingers, and the diameter of the body of which is sized to pass through the support ring formed by the ridges on the fingers. The body of the securing mechanism passes through the center of the release mechanism 220, the spring aft support, 228, the spring 226 and the spring forward support 224. The threads on the body of the securing mechanism 222 engage the internal threads in the body of the flotation cap 216. The body of the securing mechanism 222 is inserted into the body of the flotation cap 216 to fully compress the spring 226 and secure the flotation element 216 to the release mechanism 220. Other fasteners may be used as the securing mechanism 222.

The aft end of the release mechanism 220 is attached to the forward end of an annular-shaped second spring forward support 230. The aft end of the second spring forward support 230 is attached to the forward end of a constant diameter compression coil spring 232. Other types of springs or biasing mechanisms may be used in place of the spring 232. The aft end of the spring 232 is attached to the forward end of a second spring aft support 234.

Forward of the plurality of holes 214, the housing 202 has an internal annular-shaped flat shoulder 236. Forward of the flat shoulder, the housing has an internal annular-shaped beveled shoulder 238, with the radial thickness of the annulus being zero at the forward end of the shoulder 238. The second spring aft support 234 rests between the shoulder 236 and the shoulder 238. The second spring aft support 234 is prevented from moving aft by the shoulder 236 and prevented from moving forward by the shoulder 238.

Those of ordinary skill in the art will recognize that the subassembly consisting of the second spring forward support 230, the spring 232 and the second spring aft support 234 is not necessary to the invention and that the release mechanism 220 could be secured directly to the housing 202. In the exemplary embodiment, the purpose of the subassembly consisting of the second spring forward support 230, the spring 232 and the second spring aft support 234 is to reduce the transmission of shock and vibration through the housing 202 to the other components.

The recovery device includes one or more connecting mechanisms, each having a first end of which is attached to the housing 202 and a second end of which is attached to the flotation element 216. The connecting mechanism may consist of any mechanism that permits the mechanism to stay connected to both the housing 202 and the flotation element 216 while permitting the flotation element 216 to float toward the surface of the water, including, but not limited to, a thread, string, cord, cable, rope, line, filament, chain or tether In the exemplary embodiment, the second end of the tether 240 is attached to the head of the securing mechanism 222 that, in turn, is attached to the flotation element 216 as previously described. The second end of the tether 240 is attached to the head of the securing mechanism 222 by being tied through a hole in the head of the securing mechanism 222. The first end of the tether 240 is attached to a hollow reel 242 with open ends that, in turn, is attached to the housing 202. The additional tether 240 when the flotation element 216 is secured in the housing 202 is wound around the reel 242.

Forward of the plurality of holes 214 and aft of the shoulder 236, the housing 202 includes an internally threaded hole 244 that passes through the wall of the housing 202 perpendicular to the longitudinal axis of the housing 202. At the same position on the longitudinal axis of the housing 202 and one hundred eighty degrees circumferentially he internally threaded hole 244, the housing contains a blind hole 246 that enters the internal wall of the housing 202 perpendicular to the longitudinal axis of the housing 202. The diameter of the blind hole 222 may be equal to the largest diameter of the internally threaded hole 220.

The length of the reel 242 is less than the internal diameter of the housing 202. The reel 242 is located in the housing 202 such that the longitudinal axis of the reel 242 is perpendicular to the longitudinal axis of the housing 202. The interior diameter of the reel 242 is slightly larger than the diameter of the blind hole 246. The reel 242 is placed in the housing 202 such that one end of the reel 242 aligns with the internally threaded hole 244 and the other end of the reel 242 aligns with the blind hole 246. The reel 242 is held in place by a set screw 248 threaded to engage the threads in the internally threaded hole 244. The set screw 248 enters the housing 202 through the internally threaded hole 244, passes through the inside of the reel 242 and stops against the bottom of the blind hole 246. The length of the set screw 248 is such that, when one end of the set screw 248 is in contact with the bottom of the blind hole 246, the other end of the set screw 248 is recessed in the internally threaded hole 244. The set screw 248 may be replaced by other suitable fasteners.

The recovery device may include one or more covering mechanisms located at the chamber opening at the end of the housing 202 to inhibit the passage of fluid through the chamber opening at the end of the housing 202. The purpose of these one or more mechanisms may be to minimize the probability that the flotation element will be released from the housing without the housing being submerged in water.

In the exemplary embodiment, the covering mechanism to inhibit the passage of fluid through the forward end of the housing 202 is a rain skirt 250. The rain skirt 250 is a clear plastic hollow cylinder open at the aft end with a partial opening at the forward end.

The forward end of the rain skirt 250 is located aft of the flotation cap 218 and forward of the flotation element 216. The rain skirt 250 has a relatively thin wall with an inner diameter slightly larger than the outer diameter of the flotation element 216 such that the rain skirt 250 fits securely over the flotation element 216 and extends past the spring aft support 228 when the flotation element 216 is secured in the housing 202. The body of the flotation cap 218 extends through the partial opening at the forward end of the rain skirt 250 and into the centrally located hole in the flotation element 216. A portion of the rain skirt 250 may be made of a reflective material to aid in the recovery of the article at night or in low light conditions.

In the exemplary embodiment, when the recovery device 200 is submerged in water, the water enters the housing 202 through the plurality of holes 214 in the housing 202 and the space between the outside diameter of the rain skirt 250 and the inside diameter of the housing 202. When the water dissolves the water soluble material in the release mechanism 220, the force of the compressed spring 226 pulling the securing mechanism 222 forward is sufficient to push the fingers of the release mechanism 220 radially outward, releasing the securing mechanism 222 and permitting the spring 226 to decompress. The force of the spring 226 decompressing expels the securing mechanism 222, flotation element 216, rain skirt 250 and flotation cap 218 forward from the opening at the forward end of the housing 202. No longer secured in the housing 202, the flotation element 216 floats toward the surface of the water.

The tether 240 unwinds from the reel 242 as the securing mechanism 222, to which the second end of the tether 240 is attached, is carried toward the surface of the water by the flotation element 216. The tether 240 connects the flotation element 216 and the housing 202, which is attached to the article to be retrieved. The tether 240 may be sized to be sufficient to allow the flotation element 216 to reach the surface of the water. Once the flotation element 216 reaches the surface of the water, the flotation element 216 may be seen. Once the flotation element 216 may be seen, the tether 240 attached to the flotation element 216 by the securing mechanism 222 may be followed down to the housing 202, which remains attached to the article to be retrieved. Once the article to be retrieved is located, it can be retrieved.

Figure 4:
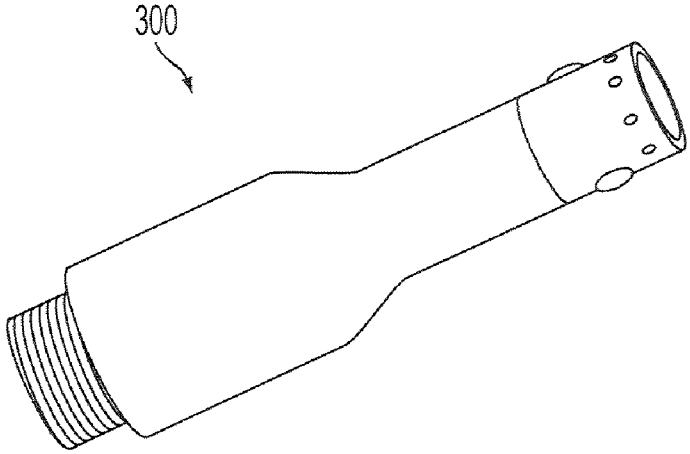
FIG. 4 depicts a flashlight that can be attached to the base member, according to an exemplary embodiment.
Figure 5:
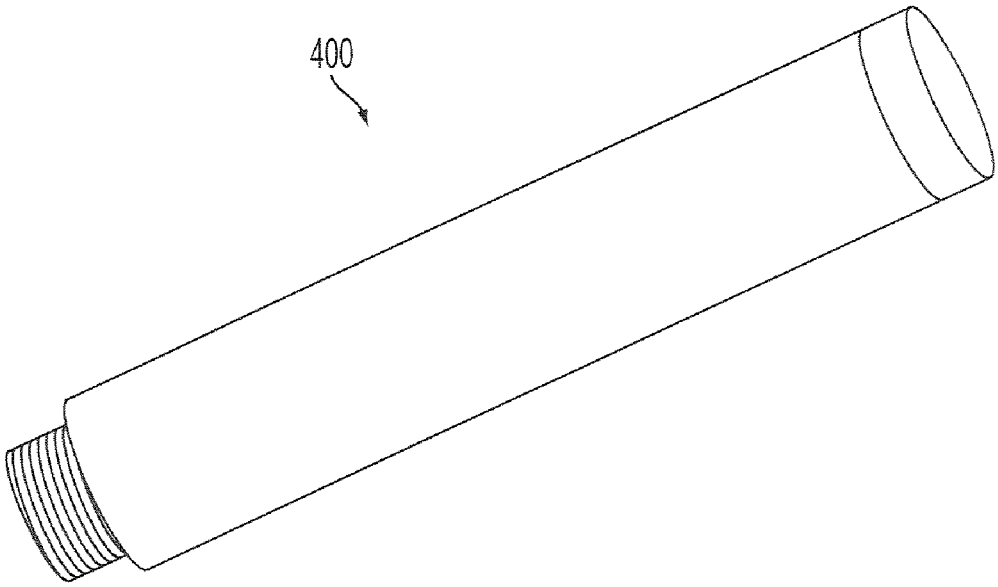
FIG. 5 depicts a dry storage tube that can be attached to the base member, according to an exemplary embodiment.

In addition to use with the recovery device 200, the base member 100 may be used to attach one of a plurality of other accessories to the forward end of the shotgun magazine 12 without interfering with the functionality of the shotgun. These accessories may include, but are not limited to, a flashlight 300, depicted in FIG. 4, and a dry storage tube 400, depicted in FIG. 5.

When the recovery device 200 is used with articles other than shotguns that do not have a feature equivalent to the threaded opening 14 at the forward end of the magazine 12, including, but not limited to, firearms other than shotguns, fishing rods, fishing gear, tools and tool boxes, the housing 202 may be attached to the article by means of a clamp or other suitable attachment mechanism.

When the recovery device 200 is used with significantly larger articles, the housing 202 may be attached directly to the article. In an exemplary embodiment, the recovery device 200 may be used in the recovery of watercraft or vessels (or parts thereof) that have become submerged inadvertently. In this embodiment, the housing 202 may be secured directly to the deck or other part of the vessel. Further, in this and other embodiments, other location aids may be used in conjunction with the recovery device 200 without altering the invention. For example a blinking or strobe light may be incorporated atop the flotation element 216 to increase the visibility of the flotation element 216. The electronic locator already used in some vessels also may be integrated with the recovery device 200. It should be appreciated that, although the size and strength of the components that constitute the recovery device 200 may increase when the recovery device 200 is used with significantly larger articles, the inventive concept remains unchanged.

Figure 6:
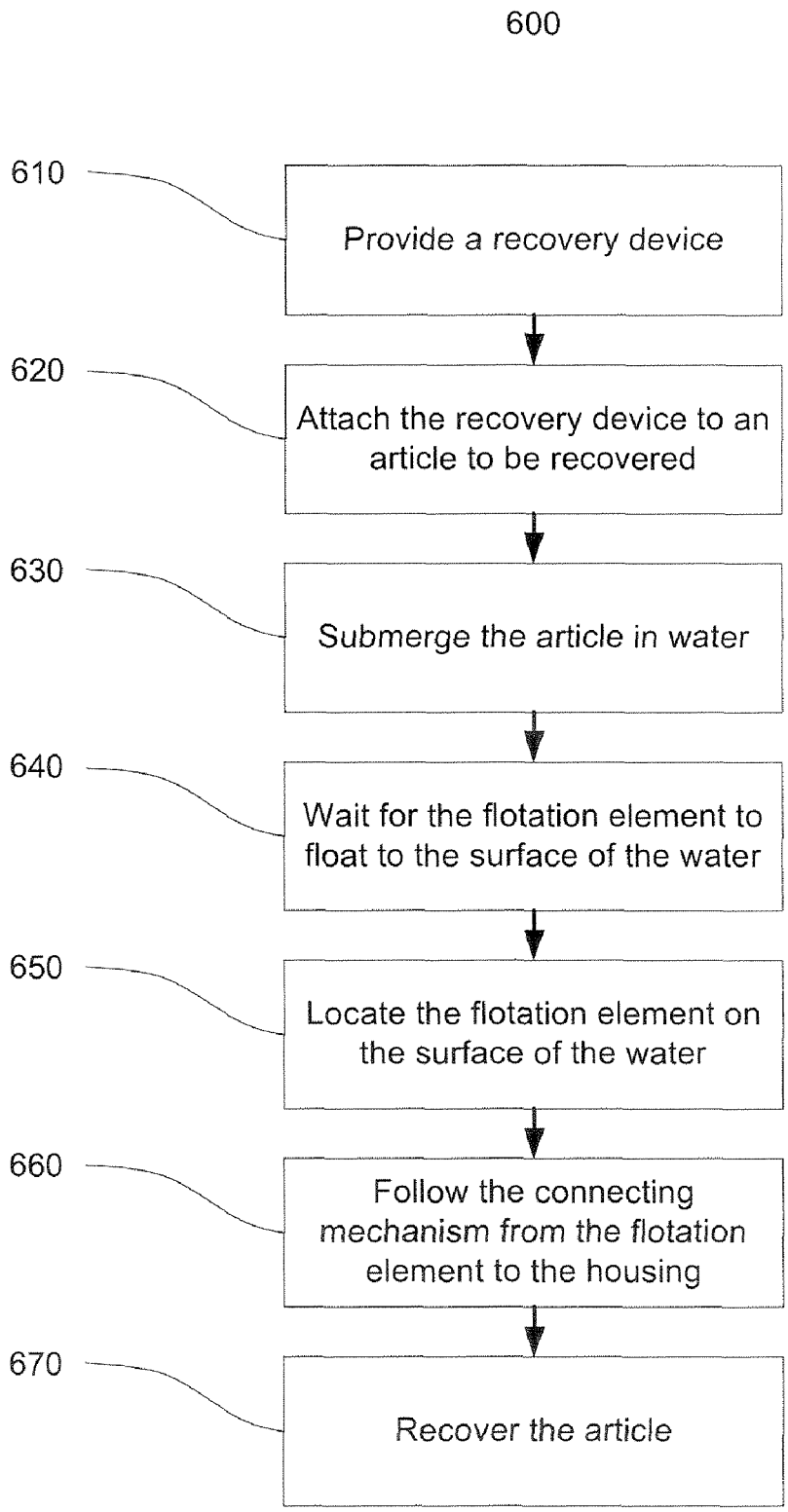
FIG. 6 depicts an illustrative flowchart of a method for recovering an article inadvertently submerged in a body of water, according to an exemplary embodiment.

FIG. 6 depicts an illustrative flowchart of a method for recovering an article inadvertently submerged in a body of water, according to an exemplary embodiment. Each block shown in FIG. 6 represents one or more processes, methods or subroutines carried out in the exemplary method 600. Referring to FIG. 6., the exemplary method may begin at block 610.

At block 610, a recovery device may be provided. The recovery device provided in block 610 may comprise a housing that defines a storage chamber with a storage chamber opening at the forward end of the housing. A flotation element that is substantially buoyant in water may be disposed in the storage chamber. A water-activated release mechanism configured to prevent movement of the flotation element toward the storage chamber opening under non-immersed conditions and to allow movement of the flotation element toward and through the storage chamber opening when the recovery device is submerged in water also may be disposed in the storage chamber. A biasing mechanism may be disposed in the storage chamber to dispose the flotation element toward the storage chamber opening. A first end of a connecting mechanism may be attached to the housing. A second end of the connecting mechanism may be attached to the flotation element.

At block 620, the recovery device may be attached to an article to be recovered. In some embodiments, the recovery device housing may be attached to a base member with the base member being attached to the article. In other embodiments, the recovery device housing may be attached to the article by a clamp or other suitable attachment mechanism. In still other embodiments, the recovery device housing may be secured directly to the article to be recovered.

At block 630, the article may be submerged in water. The submersion in water may be inadvertent.

At block 640, the one or more individuals seeking to recover the article may wait for the water-activated release mechanism to allow movement of the flotation element toward and through the storage chamber opening and for the flotation element to float to the surface of the water.

At block 650, the one or more individuals seeking to recover the article may locate the flotation element floating on the surface of the water. The floatation element may incorporate to assist the one or more individuals to locate the flotation element floating on the surface of the water, including, but not limited to, reflective coatings and lights.

At block 660, the one or more individuals seeking to recover the article may acquire the flotation element and follow the connecting mechanism, the second end of which may be connected to the flotation device, from the flotation device to the housing, which is connected to the first end of the connecting mechanism.

At block 670, the article, which may be attached to the housing, may be recovered.

In the preceding specification, various embodiments have been described with reference to the accompanying drawings. It will, however, be evident that various modifications and changes may be made thereto, and additional embodiments may be implemented, without departing from the broader scope of the disclosures as set forth in the claims that follow. The specification and drawings are accordingly to be regarded in an illustrative rather than restrictive sense.

What is claimed is:

1. A recovery device for recovering an article submerged in water, the device comprising:

a housing selectively attachable to the article at a housing attachment location and having a forward housing end and an aft housing end, the housing defining a storage chamber and having a storage chamber opening at the forward housing end;

a flotation element releasably disposed within the storage chamber, the flotation element being substantially buoyant in water;

a water-activated release mechanism disposed within the storage chamber and configured to prevent movement of the flotation element toward the storage chamber opening under non-immersed conditions and to allow movement of the flotation element toward and through the storage chamber opening when the recovery device is submerged in water;

one or more connecting mechanisms, each having a first end attached to the housing and a second end attached to the flotation element, a biasing mechanism disposed within the storage chamber adjacent the flotation element, the biasing mechanism being configured to bias the flotation element toward the storage chamber opening at the forward housing end, and a shock and vibration isolation mechanism disposed within the storage chamber intermediate the housing attachment location and the biasing mechanism, the shock and vibration isolation mechanism being configured to isolate the biasing mechanism from shock and vibration transmitted from the article through the housing.

2. The recovery device of claim 1, wherein the housing contains at least one hole in addition to the storage chamber opening, each of the at least one hole being configured to permit water to enter the storage chamber when the recovery device is submerged in water.

3. The recovery device of claim 1, wherein the housing is selectively attachable to the article by a base member having a forward base member end and an aft base member end, the forward base member end being removably attached to the aft housing end and the aft base member end being configured for attachment to the article.

4. The recovery device of claim 1, wherein the recovery device further comprises:

a covering mechanism releasably disposed at the storage chamber opening at the forward housing end, the covering mechanism being configured and positioned so as to inhibit passage of fluid through the storage chamber opening.

5. The recovery device of claim 1, wherein the water-activated release mechanism contains a water soluble material.

6. A recovery device for recovering an article submerged in water, the device comprising:

a housing selectively attachable to the article and having a forward housing end and an aft housing end, the housing defining a storage chamber and having a storage chamber opening at the forward housing end;

a flotation element releasably disposed within the storage chamber, the flotation element being substantially buoyant in water;

a water-activated release mechanism disposed within the storage chamber and configured to prevent movement of the flotation element toward the storage chamber opening under non-immersed conditions and to allow movement of the flotation element toward and through the storage chamber opening when the recovery device is submerged in water;

one or more connecting mechanisms, each having a first end attached to the housing and a second end attached to the flotation element, wherein the water-activated release mechanism contains a water soluble material and wherein the flotation element is disposed within the storage chamber intermediate the water-activated release mechanism and the storage chamber opening at the forward housing end, the water-activated release mechanism being configured to prevent movement of the flotation element toward the storage chamber opening under non-immersed conditions and to allow movement of the flotation element toward and through the storage chamber opening when the recovery device is submerged in water.

7. The recovery device of claim 5, wherein the water-activated release mechanism is disposed within the storage chamber intermediate the flotation element and the storage chamber opening at the forward housing end.

8. The recovery device of claim 1, wherein the one or more connecting mechanisms comprises a tether.

9. The recovery device of claim 8, wherein the tether is attached to the housing by a reel, one end of the tether being attached to the reel and at least a portion of the tether being wound around the reel.

10. An attachment device for attaching a recovery device for recovering an article submerged in water to a threaded forward end of a shotgun magazine, the recovery device having a housing in which is disposed a flotation element and a water-activated release mechanism configured to prevent the flotation element from releasing from the housing under non-immersed conditions and to allow release of the flotation element from the housing when the recovery device is submerged in water, the attachment device comprising:

an open, hollow, aft base member end, the internal section of which is cylindrical with an internal thread configured to engage the external thread of the threaded forward end of the shotgun magazine; and a forward base member end having a releasable attachment mechanism configured for attachment to an aft end of the recovery device housing, wherein the forward base member end is open and hollow with a cylindrical internal section that includes an internal thread configured to engage an external thread on a cylindrical external section of the recovery device.

11. The attachment device of claim 10, wherein the releasable attachment mechanism is further configured for alternative attachment to at least one accessory.

12. The attachment device of claim 11, wherein the at least one accessory includes at least one of the set consisting of a flashlight and a dry storage tube.

13. The attachment device of claim 10, wherein the attachment device further comprises an internal shoulder between the aft base member end and the forward base member end.

14. The attachment device of claim 10, wherein the attachment device further comprises an internal shoulder between the aft base member end and the forward base member end.

15. The recovery device of claim 6, wherein the housing contains at least one hole in addition to the storage chamber opening, each of the at least one hole being configured to permit water to enter the storage chamber when the recovery device is submerged in water.

16. The recovery device of claim 6, wherein the housing is selectively attachable to the article by a base member having a forward base member end and an aft base member end, the forward base member end being removably attached to the aft housing end and the aft base member end being configured for attachment to the article.

17. The recovery device of claim 6, wherein the recovery device further comprises:

a covering mechanism releasably disposed at the storage chamber opening at the forward housing end, the covering mechanism being configured and positioned so as to inhibit passage of fluid through the storage chamber opening.

18. The recovery device of claim 6, wherein the recovery device further comprises:

a biasing mechanism disposed within the storage chamber adjacent the flotation element, the biasing mechanism being configured to bias the flotation element toward the storage chamber opening at the forward housing end.

19. The recovery device of claim 6, wherein the one or more connecting mechanisms comprises a tether.

20. The recovery device of claim 19, wherein the tether is attached to the housing by a reel, one end of the tether being attached to the reel and at least a portion of the tether being wound around the reel.

* * * * *